United States Patent [19]

Viessmann

[11] 4,102,309

[45] Jul. 25, 1978

[54] BOILER FOR LIQUID OR GASEOUS FUELS

[76] Inventor: Hans Viessmann, Battenberg, Eder, Germany

[21] Appl. No.: 742,534

[22] Filed: Nov. 17, 1976

[30] Foreign Application Priority Data

Nov. 22, 1975 [DE] Fed. Rep. of Germany ..... 2552388

[51] Int. Cl.[2] ..... F22B 7/00

[52] U.S. Cl. ..... 122/136 R; 122/33; 122/DIG. 16

[58] Field of Search ..... 122/DIG. 16, 33, 37, 122/136 R, 149

[56] References Cited

U.S. PATENT DOCUMENTS

| | | | |
|---|---|---|---|
| 2,123,444 | 7/1938 | Thibaudeau | 122/149 |
| 2,736,298 | 2/1956 | Smith | 122/DIG. 16 |
| 2,751,200 | 6/1956 | Peters | 122/DIG. 16 |
| 3,007,457 | 11/1961 | Ospelt | 122/37 |
| 3,601,097 | 8/1971 | Viessmann | 122/37 |

*Primary Examiner*—Kenneth W. Sprague
*Attorney, Agent, or Firm*—Kurt Kelman

[57] ABSTRACT

A water boiler comprising a housing for the water, which is comprised of front, rear and side walls, the side wall ends being connected to the rear and front walls by external fillet weld seams. A tube is mounted in outwardly flaring apertures in the front and rear walls, and the opposite tube ends protude beyond these walls and are connected thereto by external fillet weld seams. The tube consists of a sheet metal blank having two abutting edges extending the length of the tube and an external weld seam fluid-tightly connects the abutting edges between two adjacent ones of a plurality of circumferentially spaced and longitudinally extending sheet metal profiles affixed to the inner surface of the tube. A combustion chamber is mounted within the tube and is surrounded by the sheet metal profiles which operate as flues for combustion gases generated therein. A fuel burner inlet is arranged to burn fuel in the combustion chamber, and a combustion gas discharge is in communication with the flues for removing the combustion gases.

6 Claims, 7 Drawing Figures

Fig. 1
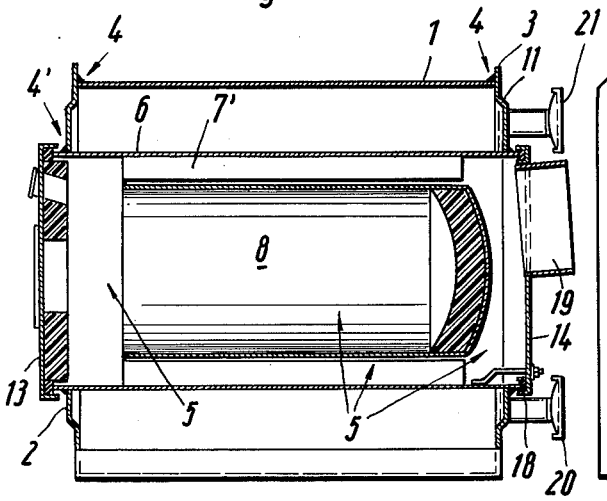
Fig. 2
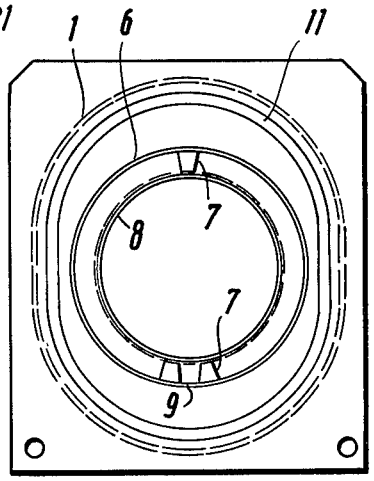
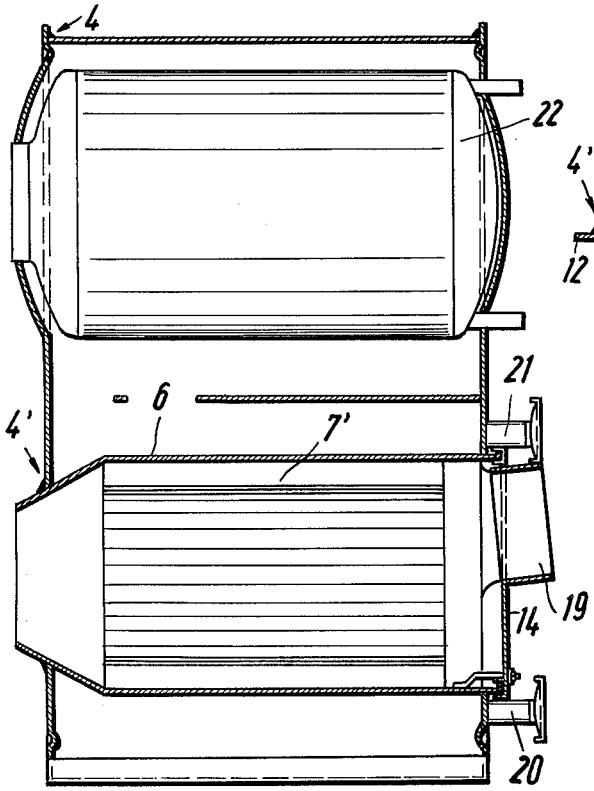
Fig. 3
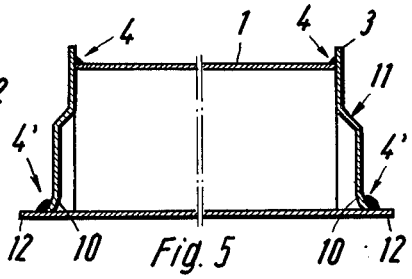
Fig. 5
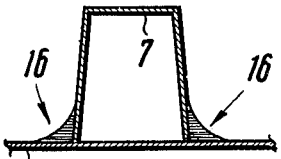
Fig. 6
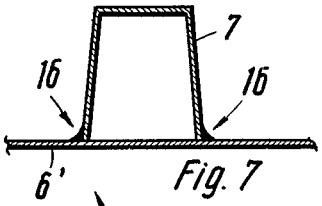
Fig. 7
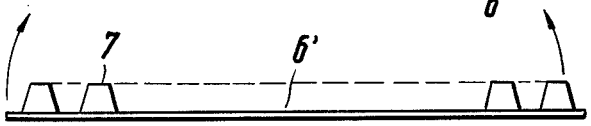
Fig. 4

BOILER FOR LIQUID OR GASEOUS FUELS

The invention relates to a boiler for liquid or gaseous fuels, for the combustion and combustion gas removal of which there is provided a combustion and gas discharge region which is sealed, except for the burner inlet and discharge openings. The boiler is mounted inside a water-carrying housing provided with inlet and return flow connections, and consisting of front, rear and side walls, whilst part of the combustion gas discharge region is formed by sheet metal profiles extending in the direction of the longitudinal axis of the boiler and mounted around the combustion region and dividing the discharge region into individual flues.

Boilers of the type mentioned are known, for example, from Swiss Patent No. 485182. Nowadays, essential requirements are that boilers should work properly, with regard to flow guidance and heat transfer while being inexpensive to manufacture, which can virtually only be achieved if boilers of this kind can be produced substantially by automatic machinery in the shortest possible time. This also opens up the possibility of production in countries which have virtually no skilled labour or only inadequate skilled labour for such demanding manufacturing processes.

It should also be taken into account that any welded seams found to be leaky in a pressure test can readily be remade, which is, of course, important for any repair weldings which may become necessary later.

Boilers according to the Swiss patent mentioned do indeed satisfy the technical operating requirements, but they do not meet the other requirements described above, to which the present invention is addressed.

This problem is solved according to the invention with a boiler of the kind described hereinbefore, from which the invention proceeds, by having the side wall placed between the front and back walls and connected to these walls in fluid-tight manner by means of external fillet welds and by the fact that a tube enclosing the combustion and discharge area is passed through corresponding apertures in the front and rear walls, projecting over the outer surfaces thereof, and is connected to the front and rear walls in liquid-tight manner also by means of external fillet welds, whilst the reverse flow combustion chamber, carried by the sheet metal profiles, is mounted in the tube which carries the sheet metal profiles placed upon it on the heating gas side.

In this embodiment according to the invention, the boiler can be welded completely automatically, apart from a few tacking points, on suitable automatic welding machines, since the weld seams for the water-carrying housing are all external fillet weld seams. The combustion and discharge area formed by the inserted tube is made from a planar sheet metal blank onto which, in a planar flattened state, the sheet metal profiles forming the flues, which are preferably constructed as U-shaped profiles, are welded, after which this sheet metal blank is bent together to form a tube and is joined with an external seam between two sheet metal profiles. This tube is then simply pushed into corresponding cutouts in the front and rear wall of the housing, whilst the external fillet welds for the housing and the tube may be welded at the same time, which naturally leads to a reduction in the total welding time. Any leaky places can readily be rewelded, and this is also true of the longitudinal weld seam of the tube which is in any case freely accessible from both sides. Some time can also be saved in manufacture by having the longitudinal weld seams with which the sheet metal profiles are placed on the tube becoming smaller in cross section from the impact end of the discharge end of the flues, which can easily be achieved by passing the welding electrodes more and more rapidly along the seam. With regard to heat transfer, this also has the advantage that there are large transitional cross sections in the region of high heat impact and small transitional cross sections at the end of the flues, to suit the reduced flow of heat.

The boiler according to the invention together with further details and advantages are described in more detail hereinafter with reference to the diagrammatic drawings of exemplary embodiments, wherein are shown diagrammatically:

FIG. 1 shows a longitudinal section through the boiler;

FIG. 2 shows a front view of the boiler without its front closure cover;

FIG. 3 shows a longitudinal section through the boiler with a built in consumption water tank and another embodiment of the tube;

FIG. 4 shows a front view of the planar sheet metal blank with the sheet metal profiles placed upon it;

FIG. 5 shows, in section, a special construction of the front and rear walls, and FIGS. 6, 7 show, in section and the sheet metal profiles placed on the planar sheet metal blanks.

According to FIG. 1, both the side wall 1, which according to FIG. 2 may be of oval shape, for example, but may also take different forms, and tube 6 are joined to the front and back walls 2, 3, respectively, by means of externally situated fillet weld seams 4,4'. To prevent disalignment during welding, the front and rear walls 2, 3 are advantageously provided with slightly outwardly bent aperture or circumferential edges 10 (FIG. 5) and with stamped shoulders 11.

Tube 6 is formed, according to FIG. 4, from a planar sheet metal blank 6' onto which, before it is bent into shape, the sheet metal profiles 7 which later form the flues 7' are welded. As shown in FIGS. 6 and 7, preferably the cross section of the weld seams 16 is large at the inflow end and small at the discharge end, and this can readily be controlled and set mechanically. The end edges of blank 6' are joined with a longitudinal weld seam 9 (FIG. 2) to form tube 6. The cutout portion of sheet metal which is formed when the rear wall is produced is advantageously worked to form the rear wall cover 14, as shown in FIG. 1, by for example welding on a ring 18 of U-shaped profile containing a sealing ring. In order to fix the cover 14 on which the discharge pipe 19 is also located, clamping bolts 15 are welded to tube 6, by means of which bolts the cover 14 with its sealing ring can be firmly clamped against the protruding end 12 of tube 6.

The reverse flow combustion chamber 8 is of cylindrical pot-shaped construction, as shown in FIG. 1, and can easily be pushed into the free space between the sheet metal profiles 7 from in front or behind. Stop limits for this insertion are not shown.

As shown in FIG. 3, this constructional principle does not change in any respect if a reserve water tank 22 is inserted in the housing, which will then be upwardly enlarged. Forward and return flow connections 20, 21 serve to connect it to the heating system. According to FIG. 3, tube 6 may be tapered conically at the burner end (burner not shown) in front of the sheet metal profiles 7, whereby the front cover 13 can be kept smaller, and this leads to a saving in materials of up to 25% for the cover, particularly in the case of larger boilers.

In this case, tube 6 naturally has to be pushed into the housing from the rear wall. This construction of tube 6 may, of course, also be provided in a boiler according to FIG. 1 and the construction of the tube according to FIG. 1 may be provided in a boiler according to FIG. 3.

All the weld seams are easily accessible for subsequent or repair welding and, moreover, the combustion and gas discharge region 5 is easy to clean after one or both covers 13, 14 has been opened and possibly after removing the combustion chamber 8. Only some of the sheet metal profiles 7 are indicated in FIGS. 2 and 4. In fact, these sheet metal profiles 7 are uniformly distributed around the entire circumference. The outer wall of the combustion chamber 8 lies close against the sheet metal profiles 7. In FIG. 3, the boiler is shown without the combustion chamber which is to be inserted and without the front cover which in this case may be kept substantially smaller than that in FIG. 1.

In the exemplary embodiment according to FIG. 3, the cone of tube 6 or the aperture thereof is, of course, advantageously of such dimensions that the combustion chamber may also be pulled out towards the front of the boiler, since there are generally obstacles in the form of walls or the like at the back.

I claim:

1. A water boiler comprising, in combination:

(a) a housing for holding the water to be boiled and comprised of (1) a front wall, (2) a rear wall, (3) a side wall extending between the front wall and the rear wall, the front and rear walls defining apertures surrounded by outwardly flaring edges, and (4) external fillet weld seams connecting the side wall fluid-tightly to the front and rear walls, (b) a tube mounted in the apertures of the front and rear walls, the tube defining outer and inner surfaces, the outer surface of the tube defining a water chamber with the housing, and the tube having opposite ends protruding, respectively, beyond the front and rear walls, (1) the tube consisting of a sheet metal blank having two abutting edges extending the length of the tube, (c) external fillet weld seams connecting the outwardly flaring edges of the rear and front wall apertures fluid-tightly to the protruding ends of the tube, (d) circumferentially spaced and longitudinally extending sheet metal profiles affixed to the inner surface of the tube, (e) an external, longitudinally extending weld seam fluid-tightly connecting the abutting edges of the sheet metal blank between two adjacent ones of the profiles, (f) a housing defining a fuel combustion chamber mounted within the tube and surrounded by the sheet metal profiles, the combustion chamber being in communication with the sheet metal profiles whereby the profiles operate as flues for combustion gases generated in the combustion chamber, (g) a fuel burner inlet arranged to burn fuel in the combustion chamber, and (h) a combustion gas discharge in communication with the flues for removing the combustion gases.

2. The water boiler of claim 1, wherein the front and rear wall have a shoulder adjacent the external fillet weld seams connecting the side wall fluid-tightly to the front and rear walls.

3. The water boiler of claim 1, further comprising covers dismountably and fluid-tightly mounted on the protruding ends of the tube, the fuel burner inlet being arranged in one of the covers and the combustion gas discharge being arranged in the other one of the covers.

4. The water boiler of claim 3, further comprising clamping bolts arranged to hold the cover wherein the discharge is arranged on the protruding tube end.

5. The water boiler of claim 1, further comprising longitudinally extending external weld seams affixing the sheet metal profiles to the inner surface of the tube, the cross sectional area of the weld seams diminishing progressively in the direction of the combustion gas discharge.

6. The water boiler of claim 1, wherein the tube comprises a conical end portion extending in the direction of the fuel burner inlet, the sheet metal profiles extending to the conical end portion.

* * * * *